US005921381A

United States Patent [19]

Von Arx

[11] Patent Number: 5,921,381

[45] Date of Patent: Jul. 13, 1999

[54] LOCKING BUTTON

[75] Inventor: Theodore T. Von Arx, LaCrescent, Minn.

[73] Assignee: Watlow Electric Manufacturing Company, St. Louis, Mo.

[21] Appl. No.: 09/003,550

[22] Filed: Jan. 6, 1998

[51] Int. Cl.[6] ..... H01H 3/20; H01H 13/00

[52] U.S. Cl. ..... 200/345; 200/318.2

[58] Field of Search ..... 200/4, 520, 530, 200/534, 566, 318, 318.1, 318.2, 321, 329, 341, 345

[56] References Cited

U.S. PATENT DOCUMENTS

| | | | |
|---|---|---|---|
| 3,345,489 | 10/1967 | Kemnitz | 200/157 |
| 3,539,736 | 11/1970 | Naimer | 200/4 |
| 3,895,205 | 7/1975 | Tharp | 200/340 |
| 4,020,305 | 4/1977 | Schwartz | 200/159 R |
| 4,280,026 | 7/1981 | Alessio | 200/157 |
| 5,593,022 | 1/1997 | Schaeffer et al. | 200/308 |
| 5,799,520 | 9/1998 | Laabs et al. | 70/360 |

*Primary Examiner*—Michael A. Friedhofer
*Attorney, Agent, or Firm*—Herzog, Crebs & McGhee LLP

[57] ABSTRACT

A selectively lockable button structure allows for simple and easy mechanical button deactivation and reactivation. The button structure is especially adapted for interface panels of various types of electrical equipment wherein there may be a need for button lockout once the equipment is installed. The button structure includes a button and button retention/housing portion. The button has a head and body with the body terminating in radially outwardly extending flanges that allows easy button installation into the button retention portion of the interface panel but inhibits button removal therefrom. The button retention portion includes angled, diametrically opposed shelves, each shelf of which has a pair of positive lock interference tabs. The button head and the shelves/tabs co-act such that in one rotational position the button is depressible (unlocked) while in another rotational position, the button is not depressible (locked). In the locked position the underside head surface is raised and rests on the shelves, preventing the downward movement of the button upon application of a downward force.

11 Claims, 5 Drawing Sheets

LOCKING BUTTON

FIELD OF THE INVENTION

The present invention relates to depressible button structures especially depressible button structures associated with equipment face plates or panels and, more specifically, to selectively lockable depressible button structures.

BACKGROUND OF THE INVENTION

Buttons are commonplace structures for turning on and off various types of devices, or for selecting items or functions in menu type setups. In most instances buttons are associated with electrical equipment and can control a variety of functions depending on the particular arrangement. These button structures generally operate in a simple manner wherein the activation/deactivation function is accomplished by depressing and releasing the button. The button may be directly coupled to an electrical circuit or may be used as an interface to actuate an electronic device.

Electrical or electronic equipment, such as process controllers, deep fryers, and other programmable controllers, utilize interface panels or faceplates generally having a plurality of buttons to allow the user to operate and/or program the device. The depress-and-hold and the-depress-and-release actions on the button cause the controller, for instance, to perform a particular function. The buttons may control a variety of functions and may also be programmable depending on the particular application or device. Programmable process controllers, for instance, have many buttons associated with the front panel in order to program and operate the controller. In some instances, however, it may be necessary to block or restrict the use of a particular button or a group of buttons. In the case of a process controller, while there may be a plurality of buttons, only certain of those buttons may actually be used in the field or used by an operator once the device is installed in a customer application. Also, these buttons may be used prior to use in the field or prior to use in the customer application. It then becomes necessary to prevent the utilization of the button once its use is no longer needed or allowed.

This occurs in original equipment manufacturer (OEM) situations and/or in the post-installation process where single products, such as process controllers, may be programmed to perform a variety of tasks. Once the controller has been installed and/or programmed for the particular application, it may be necessary to restrict or prevent access to some of the buttons. It may certainly be possible to restrict or prevent access to the function of the button by deactivating the same by firmware, software, or the like. However, these methods are too costly or difficult to implement. They also do not allow for easy reactivation or use, should the need arise, without compromising the security of the lockout through software reactivation schemes.

It is thus an object of the present invention to provide a lockable mechanical button structure.

It is another object of the present invention to provide a selectively lockable mechanical button structure especially for use in an interface panel or faceplate associated with an electrical device.

It is a further object of the present invention to provide an interface panel for an electrical device, such as a process controller, having buttons that can be disabled or enabled by making an adjustment of the button.

SUMMARY OF THE INVENTION

The present invention is a depressible-type button structure that is selectively and mechanically lockable so as to prevent actuation thereof.

In one form thereof, the present button structure is defined by a button disposed within a containment, the button interactable with a lockout structure within the containment that selectively allows and prohibits mechanical depression or actuation thereof depending on the orientation of the button within the containment relative to the lockout structure.

The containment may take the form of a bore with the lockout structure defined by ledges extending radially inward from the inner periphery or boundary of the containment. The button includes a head and body sized to fit within the containment. The head includes cutouts corresponding in number and generally complementary in shape to the ledges such that rotational position of the head in the containment relative to the ledges determines whether the button is in a locked position or an unlocked position. The body axially extends from an underside of the head and terminates, distal from the head, in radially outwardly extending flanges. The body flanges assist in retaining the button within the containment.

In a preferred embodiment, the containment includes two, diametrically opposed, angled ledges, each ledge having a pair of friction tabs or detent points, one at each end thereof. The friction tabs assist in positively retaining the button in the chosen rotational position, i.e. the locked or unlocked mode. When the button head is rotationally positioned such that the cutouts are adjacent the ledges, the button is in an unlocked position and may be depressed. As the button head is rotated 90 degrees relative to the unlocked position, portions of the lower or underside surface of the head are caused to rest upon the ledges, preventing axially downward movement of the button (locked position). The button is retained in this position by the friction tabs.

In another form thereof, the present invention is a panel structure for a control device or the like having a plurality of selectively lockable button structures as described above. The panel may include an overlay that is situated over the plurality of buttons once the rotational orientation of the button is set, such as in a food service type controller.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 5:
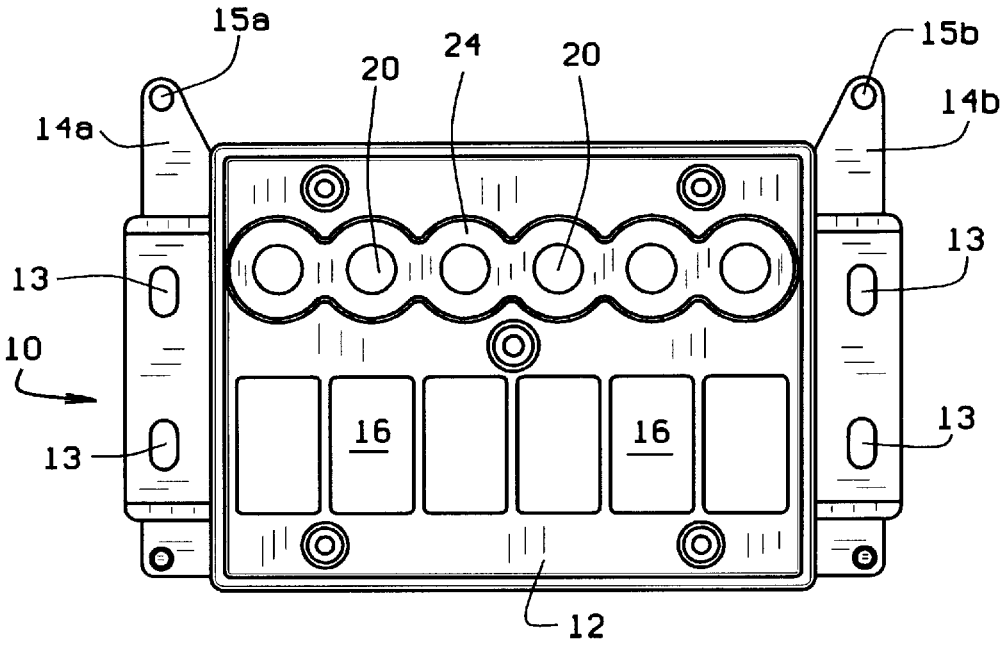
FIG. 5 is a rear view of the panel.
Figure 4:
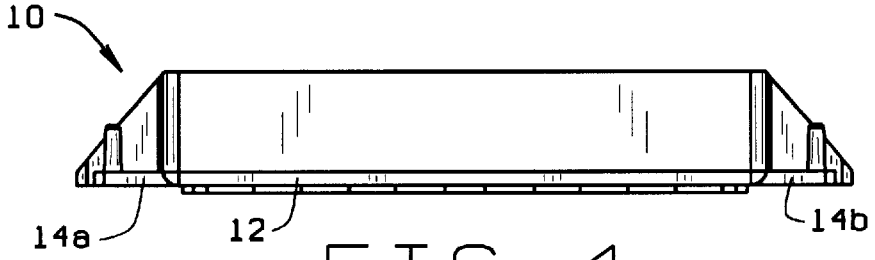
FIG. 4 is a side view of the panel.
Figure 3:
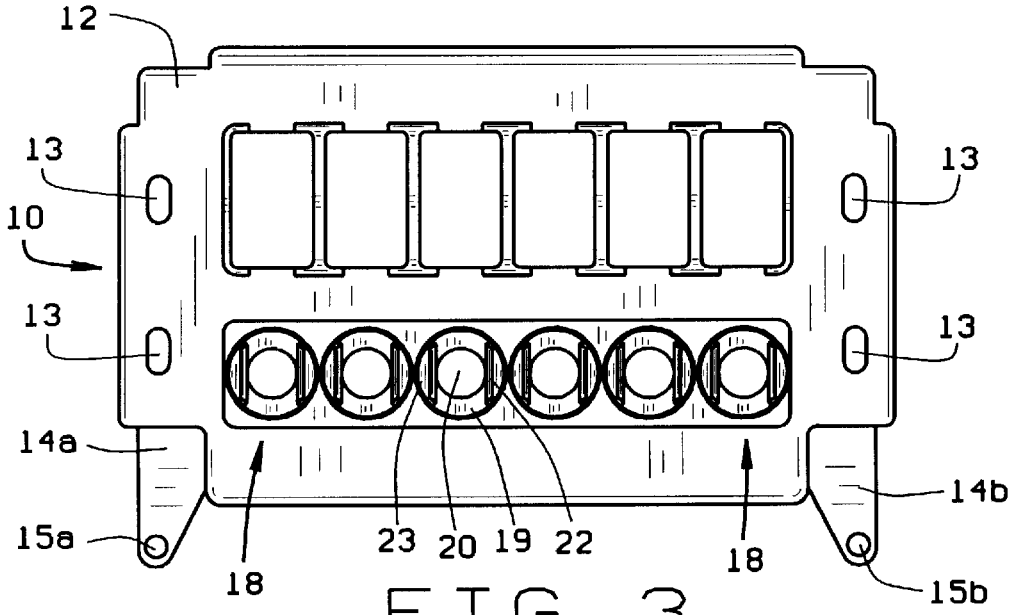
FIG. 3 is a front view of the panel.
Figure 6:
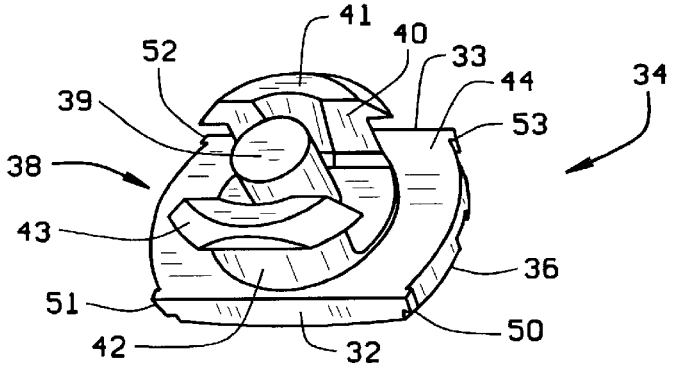
FIG. 6 is a perspective view of the underside of a button in accordance with the principles of the present invention.
Figure 7:
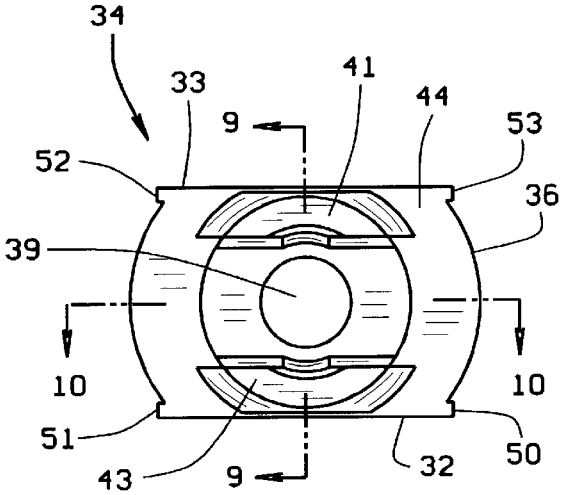
FIG. 7 is a bottom plan view of the button of FIG. 6.
Figure 8:
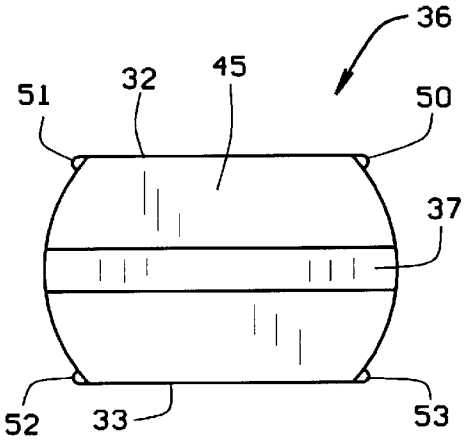
FIG. 8 is a top plan view of the button.

Referring now to FIGS. 3–5 there is shown a front, side, and rear view respectively, of a panel generally designated 10 of the type used for a process controller or the like (not shown). The panel 10 is generally made of a plastic and includes a plate 12 having a plurality of mounting holes 13 on opposite ends thereof and opposite mounting flanges 14*a*, 14*b*, each having mounting holes 15*a*, 15*b*, respectively. Disposed in the plate 12 are a plurality of switch cutouts 16 through which switches or the like extend when the panel 10 is mounted to the process controller. It should thus be apparent that the panel 10 is adapted to be mounted to a process controller or similar device. However, while the present invention is generally disclosed with respect to a process controller and front panel, the present invention is not limited to use in a panel and/or process controller, but rather is usable in any situation where a selectively lockable button structure is desired.

Additionally disposed in the panel 10 are a plurality of button containments or cutouts generally designated 18. While the present panel 10 includes a plurality of button containments, it should be understood that the present principles apply to a button containment structure and button, collectively a button structure, regardless of the number, and thus for purposes of the present disclosure, only one such button structure will be described. The button containment 18 has a first diameter and depth portion defined by a first ledge 19 with a bore 20 extending therethrough. As described in greater detail hereinbelow, extending radially inward within the first diameter of the button containment 18 is a first shelf 22 and a second shelf 23. As shown, and preferably, the first shelf 22 is diametrically opposite the second shelf 23, each being essentially semi-circular in shape.

Figure 1:
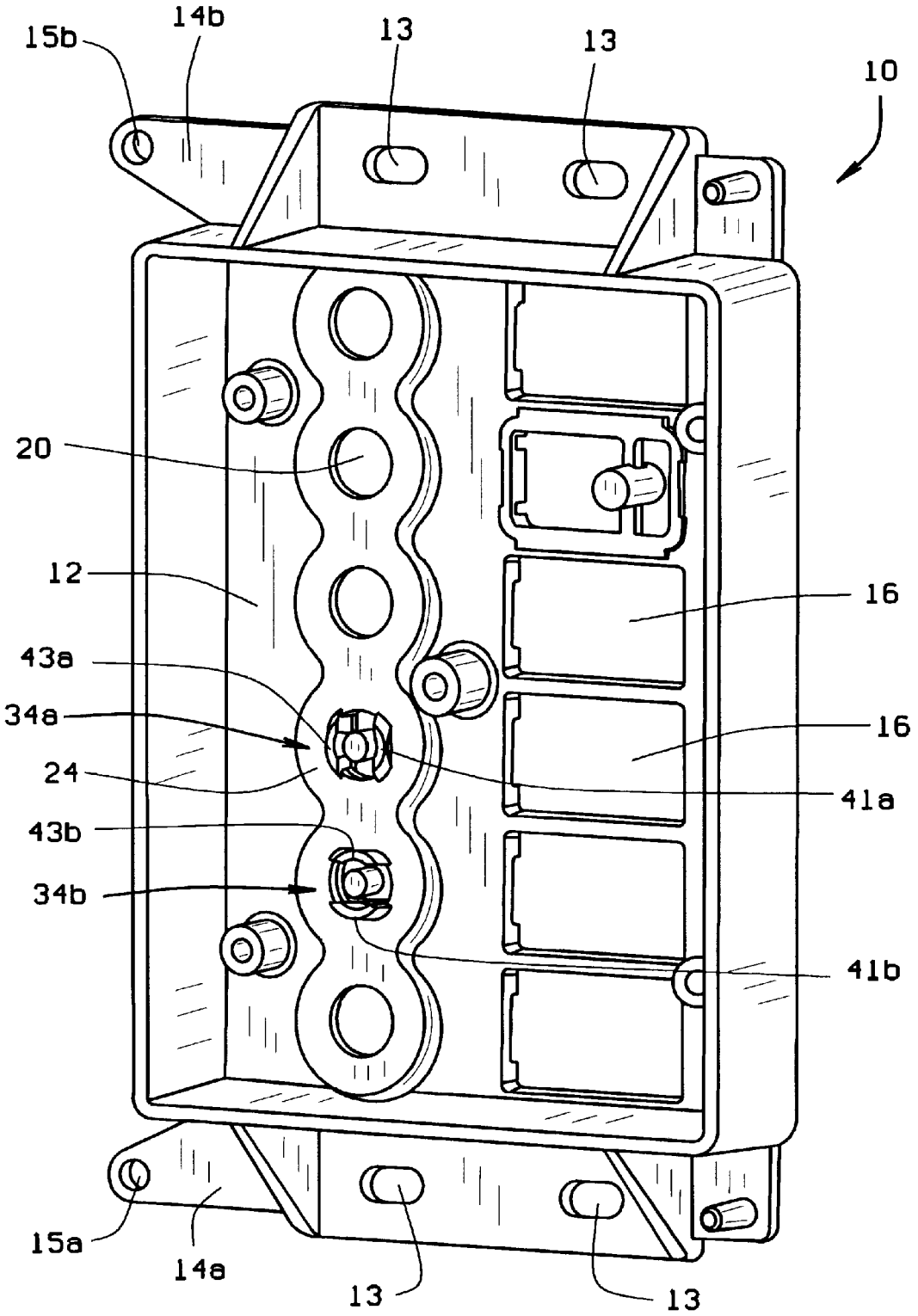
FIG. 1 is a rear perspective view of a generic panel, face or cover plate embodying the present button structure.

Briefly referring to FIG. 1, the rear side of the panel 12 is shown and attention is directed to the area around the button containments wherein there is a thickened or raised portion 24 whose depth or thickness defines the depth portion of each button containment.

As best depicted in FIG. 2 and FIGS. 11–13, the shelves 22, 23 are raised portions from the first ledge 19 and have respective angled portions 25, 26 that extend along the front surface thereof and slope downwardly towards the first ledge 19. Disposed at the opposite ends of each angled portion 25, 26 at the junction point between the inner peripheral wall of the button containment 18 and the angled portion are two detent or friction tabs 28, 29 and 30, 31 forming pairs of tabs corresponding to each angled portion. Each tab 28, 29, 30, 31 extends slightly above the surface of its respective shelf 22, 23.

Figure 9:
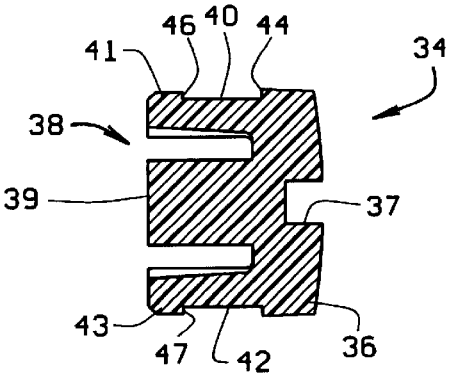
FIG. 9 is a cross-sectional view of the button taken along line 9—9 of FIG. 7.
Figure 10:
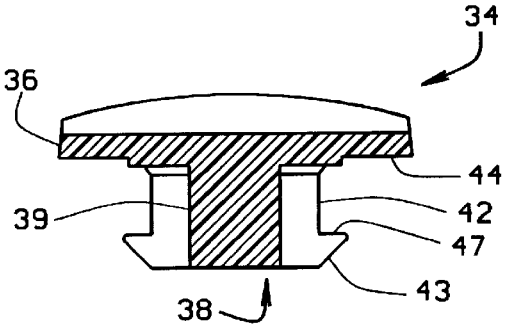
FIG. 10 is a cross-sectional view of the button taken along line 10—10 of FIG. 7.

With particular reference now to FIGS. 6–10, a button structure 34 is depicted. The button 34 includes a head 36 generally of an elliptical shape except having two side cut portions 32, 33 defining cutouts. The button structure 34 may be made of plastic or other suitable material and is preferably formed as a unitary member. Extending from the underside surface 44 of the head 36 is a body portion 38 defined by a central post 39, a first stem 40 and first end flange 41, and a second stem 42 and second end flange 43. The head 36 has a longitudinal slot 37 disposed on an upper surface 45 for receipt of a tool, such as a slotted screwdriver, for rotating the button 34 in order to put the button 34 into a locked or unlocked position as hereinbelow described. As best depicted in FIGS. 9 and 10, the flanges 41, 43 respectively define upper surfaces 46, 47 that are utilized as stop surfaces between the button 34 and the undersurface 24. Additionally, located at each corner of the head 36 are ears 50, 51, 52, 53 that project outwardly. The ears 50, 51,51, 53 along with the tabs 28, 29, 30, 31, assist in positively retaining the button in the chosen rotational position or mode.

Again referring to FIG. 1, the bottom portions of the two buttons 34*a* and 34*b* are shown extending through the respective bores (20*a*, 20*b* if discernable) such that the flange pairs 41*a*, 43*a* and 41*b*, 43*b* engage the raised portion 24 and retain the respective button 34*a*, 34*b*. The flanges of the buttons allow the buttons to be rotatably retained within the respective button containment.

Figure 2:
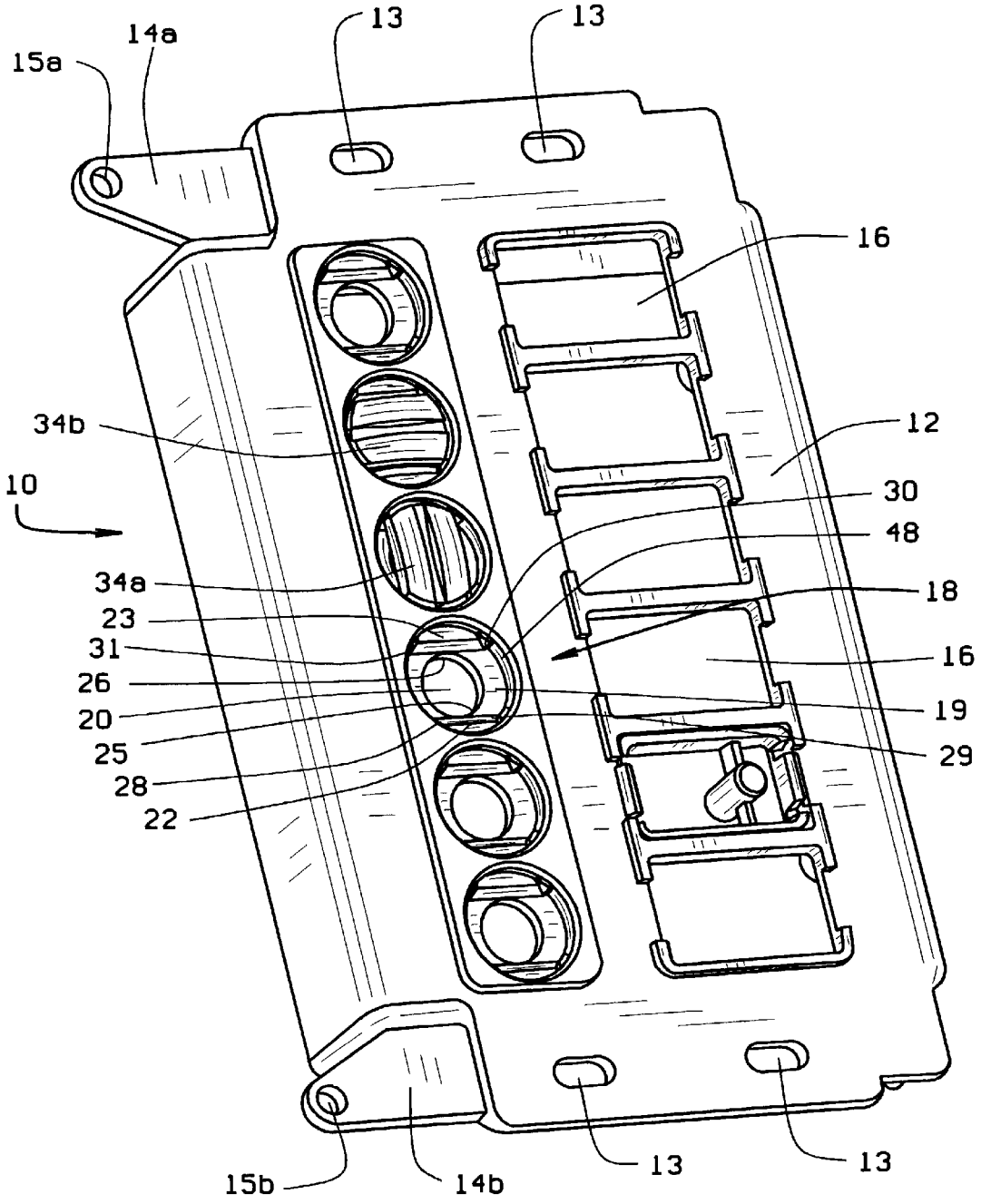
FIG. 2 is a front perspective view of the panel of FIG. 1.
Figure 11:
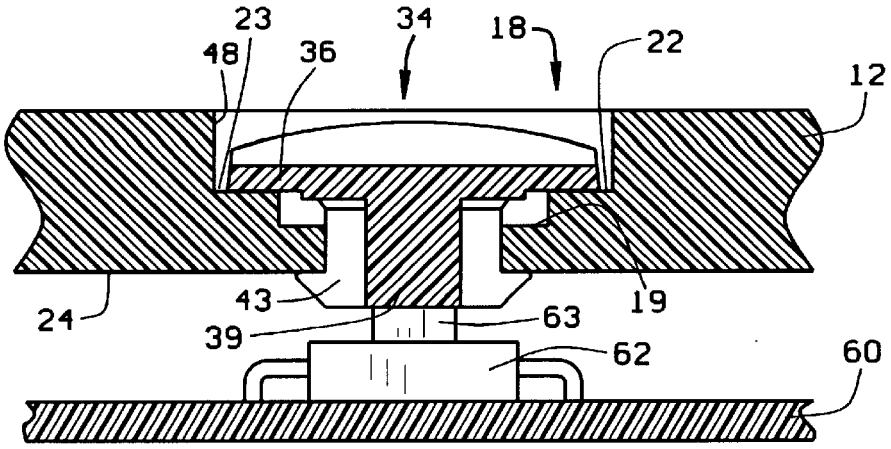
FIG. 11 is an enlarged, cross-sectional view of a portion of the panel and a button in relation to a printed circuit board switch, showing the button in a locked position.
Figure 12:
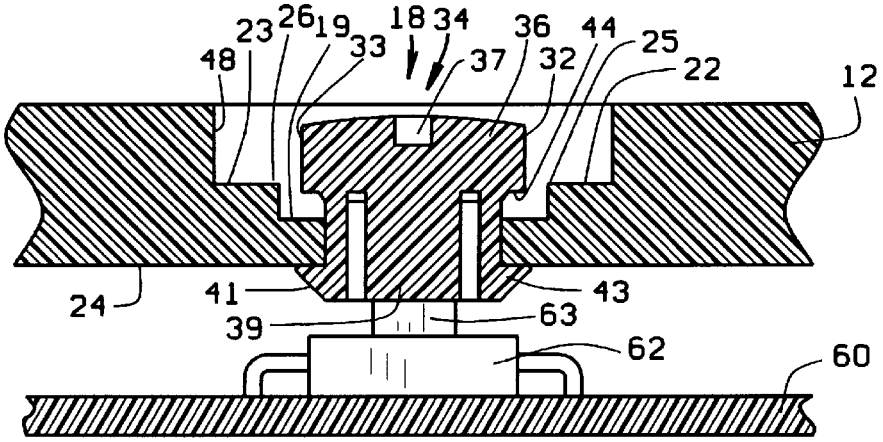
FIG. 12 is an enlarged, cross-sectional view of the portion of the panel and button in relation to the printed circuit board switch of FIG. 11, showing the button in an unlocked, non-depressed position.
Figure 13:
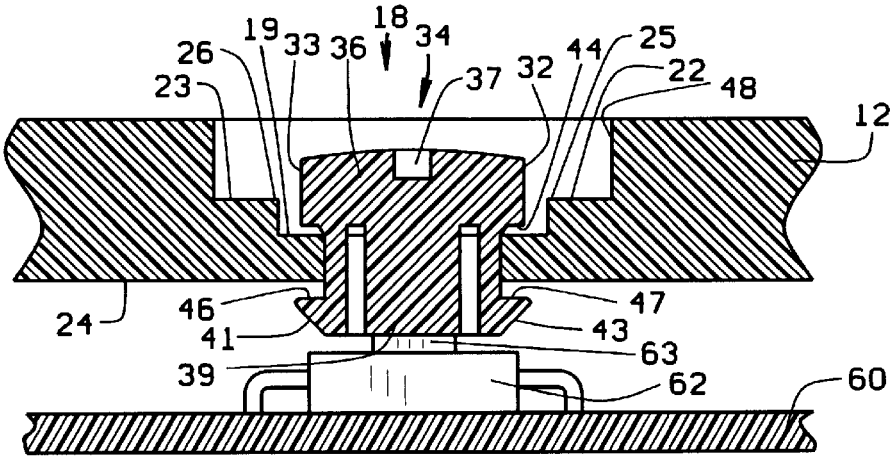
FIG. 13 is an enlarged, cross-sectional view of the portion of the panel and button in relation to the printed circuit board switch of FIG. 11, showing the button in an unlocked and depressed position.

Attention is now directed to FIGS. 11–13 wherein the operation of the present overall button structure will be described. FIG. 11 depicts a locked state of the button 34 within the button containment 18, while FIG. 12 depicts and unlocked, but not depressed, state of the button 34 within the button containment 18. FIG. 13 depicts the button 34 in an unlocked and depressed state within the button containment 18. Each of the FIGS. 11–13, shows the button 34 within the button containment 18 of the panel 12 as mounted to a device and coupled to a switch element 62 operably mounted onto a printed circuit board 60. The central post 39 of the button 34 is in contact with an actuator 63 of the switch element 62. In order for the button 34 to be in a locked state or mode, as depicted in FIG. 11, a screwdriver or the like is placed into the slot 37 on the head 36 and rotated such that the undersurface 44 of the head 36 engages and rests upon the two shelves 22, 23. In so doing, the ears 50, 51, 52, 53 frictionally rotate about the tabs 28, 29, 30, 31, depending upon the direction of rotation. As the undersurface 44 is caused to rest upon the shelves 22, 23, the upper surfaces 46, 47 of the respective flanges 41, 43 engages the undersurface of member 24. This effectively prohibits or restricts upward axial movement of the button 34 since the flanges 41, 43 engage the undersurface of the member 24. At the same time, the downward axial movement of the button 34 is restricted by engagement of the undersurface 44 of the head 36 upon the respective shelves 22, 23. This position is as shown in FIG. 2, with the button labeled 34*a*. Because of the ears 50, 51, 52, 53 and the tabs 28, 29, 30, 31, the button 34 is retained in the locked position until a positive rotational force is applied. When a positive rotational force is applied and the button 34 is rotated 90 degrees in either direction, the button 34 is in the unlocked position.

The unlocked position is shown in FIG. 12, and as button 34*b* in FIG. 2. When the button 34 is in the unlocked position, the side portions 32, 33, of the button head 36 are adjacent the shelves 22, 23 and thus the shelves 32, 33 do not restrict the axial travel of the button 34. The axial travel of the button 34 is restricted only by the ledge 19 when the undersurface 44 of the head 36 makes contact therewith. However, this amount of axial travel is sufficient to allow actuation of the switch element 63 of the switch 63.

The axial travel distance of the button 34, when in the unlocked position is thus depicted in FIG. 13. Generally, the actuator 63 of the switch element 62 is spring biased such that as the axially downward pressure against the button 34 is released, the button 34 will return to an unbiased state as depicted in FIG. 12.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended or any claims.

What is claimed is:

1. A button structure to be located inside a housing comprising:

a containment defined by an interior boundary of the housing, said containment including a radially inwardly extending structure from said interior boundary;

a button disposed in and axially movable within said containment, wherein said button is rotatable relative to said containment into a first mode whereby said button is restricted from axial movement by said radially inwardly extending structure, and rotatable relative to said containment into a second mode whereby said button is freely axially movable within said containment;

wherein said radially inwardly extending structure is a pair of diametrically opposed shelves, and said button includes a head shaped to engage said shelves when said button is in said first mode, and to axially clear said shelves when said button is in said second mode; and wherein said shelves have two ends each, an angled front portion, and a detent tab located at each of said end thereof.

2. The button structure of claim 1, wherein said button includes a body axially extending from said head and a pair of flanges disposed on said body at an end axially distal from said head, said containment having a bore therein through which said flanges extend.

3. A button structure to be located inside a housing comprising:

a containment defined by an inner peripheral wall of the housing and having a first depth terminating in a bottom portion, a bore extending from said bottom portion and in communication with said first depth, and shelves extending radially inward from said inner peripheral wall;

a button disposed in said containment and selectively axially movable therein, said button having a head portion and a body portion, said head portion shaped such that when said button is in a first rotatable position said button is axially downwardly movable within said containment and when said button is in a second rotatable position said button is restricted from axially downwardly movement within said containment by said shelves; and wherein said shelves are a pair of diametrically opposed shelves each having a sloped front portion and a pair of detent tabs at either end thereof.

4. The button structure of claim 3, wherein said body portion includes flanges that extend through said bore.

5. The button structure of claim 3, wherein said second rotatable position is 90 degrees from said first rotatable position.

6. The button structure of claim 3, further comprising a head disposed at an end of said button opposite said bottom portion of said containment, wherein said shelves are semicircular in shape, and said head is capsule shaped.

7. The button structure of claim 3, further comprising:

a head disposed at an end of said button opposite said bottom portion of said containment;

a slot disposed in an upper surface of said head; and said body including a central post, a first arm terminating in a first flange, and a second arm terminating in a second flange.

8. A depressible button structure associated with a panel especially for an electrical device, the depressible button structure comprising:

a bore disposed within said panel, said bore having a first depth terminating in a bottom portion, said bore extending from said bottom portion and in communication with said first depth, and shelves extending radially inward from an inner peripheral wall of said panel; and a button disposed in said bore and selectively axially movable therein, said button having a head portion and a body portion, said head portion being shaped such that when said button is in a first rotatable position said button is axially downwardly movable within said bore and when said button is in a second rotatable position said button is restricted from axially downwardly movement within said bore by said shelves;

a head disposed at an end of said button opposite said bottom portion of said bore; and wherein said shelves are a pair of diametrically opposed shelves each having a sloped front portion and a pair of detent tabs at either end thereof.

9. The button structure of claim 8, wherein said second rotatable position is 90 degrees from said first rotatable position, said shelves are semicircular in shape, and said head is capsule shaped.

10. The button structure of claim 8, wherein axial travel is limited by an underside surface of said head contacting an upper surface of said shelves when said button is in said second rotatable position.

11. The button structure of claim 10, wherein absolute axial travel is limited when said button is in said first rotatable position by said underside of said head contacting an upper surface of said bottom portion.

* * * * *